US006189844B1

(12) United States Patent
Chang

(10) Patent No.: US 6,189,844 B1
(45) Date of Patent: Feb. 20, 2001

(54) KEYBOARD SUPPORT DEVICE ON A DESK

(76) Inventor: Chien-Kuo Chang, Fl. 10-2 , No. 447, Sec. 3, Wen-Hsin Rd., Taichung (TW)

( * ) Notice: Under 35 U.S.C. 154(b), the term of this patent shall be extended for 0 days.

(21) Appl. No.: 09/368,491

(22) Filed: Aug. 5, 1999

(51) Int. Cl.[7] ..... F16M 11/00
(52) U.S. Cl. ..... 248/176.1; 248/918
(58) Field of Search ..... 248/918, 289.11, 248/125.7, 176.1, 276.1

(56) References Cited

U.S. PATENT DOCUMENTS 5,062,609 * 11/1991 Hames et al. ..... 248/176.1 X
5,528,796 * 6/1996 Perry et al. ..... 248/918 X
6,045,179 * 4/2000 Harrison ..... 248/918 X

* cited by examiner

*Primary Examiner*—Ramon O. Ramirez
(74) *Attorney, Agent, or Firm*—Rosenberg, Klein & Lee

(57) ABSTRACT

A keyboard support device for a desk includes two posts each having a catching member so as to slidably engage with a beam connected below a top of the desk. Two rails each have a socket connected to a first end thereof so that the two sockets are respectively pivotally connected to the two posts. Each rail has a member slidably received in a second end thereof and a bar is connected between the two rails so as to maintain the two rails in parallel with each other. A tray is connected to the two members so that a keyboard is put on the tray. The tray can be pivoted and moved relative to the top of the desk.

6 Claims, 3 Drawing Sheets

KEYBOARD SUPPORT DEVICE ON A DESK

FIELD OF THE INVENTION

The present invention relates to a keyboard support device which is connected below the top of the desk and pivotable and movable relative to the top so that the keyboard support device can be positioned according to different users' needs.

BACKGROUND OF THE INVENTION

Some conventional desks have a keyboard tray connected beneath the top of the desk and the keyboard tray is guided between two rails fixedly connected to the bottom of the top so that the user can pull the keyboard tray and use the keyboard put on the keyboard tray. However, the keyboard tray is limited to be moved between the two rails so that the user has to sit in front of the top at a fixed position so that he/she can properly operate the keyboard. Different users have different habits to operate the keyboard so that the conventional keyboard tray can only fit very few users' habit. In fact, such the conventional keyboard tray is not a ideal keyboard tray that most of the users appreciate. Furthermore, because the keyboard tray can only moved in a direction perpendicular to the top of the desk so that if a user unintentionally hits the keyboard tray from a side when he/she wants to leave from the desk, the keyboard tray cannot pivot so that the user feels pain.

The present invention intends to provide a keyboard support device which can be pivoted and moved relative to the top of the desk so that the different users can adjust the keyboard support device to fit their special needs. The keyboard support device of the present invention improves the shortcomings and mitigates the disadvantages of the conventional keyboard tray.

SUMMARY OF THE INVENTION

In accordance with one aspect of the present invention, a keyboard support device is provided and comprises two posts each having a catching member to be connected to a beam below the top of the desk. Two rails each have a socket which is pivotally connected to the post corresponding thereto. Each rail has a member slidably received in a second end thereof and a tray is connected to the two members.

The main object of the present invention is to provide a keyboard support device which can be pivoted and moved relative to the top of the desk so that the users may move the keyboard to desired positions by shifting the keyboard support device.

Further objects, advantages, and features of the present invention will become apparent from the following detailed description with appropriate reference to the accompanying drawings.

DETAILED DESCRIPTION OF THE PREFERRED EMBODIMENT

Figure 1:
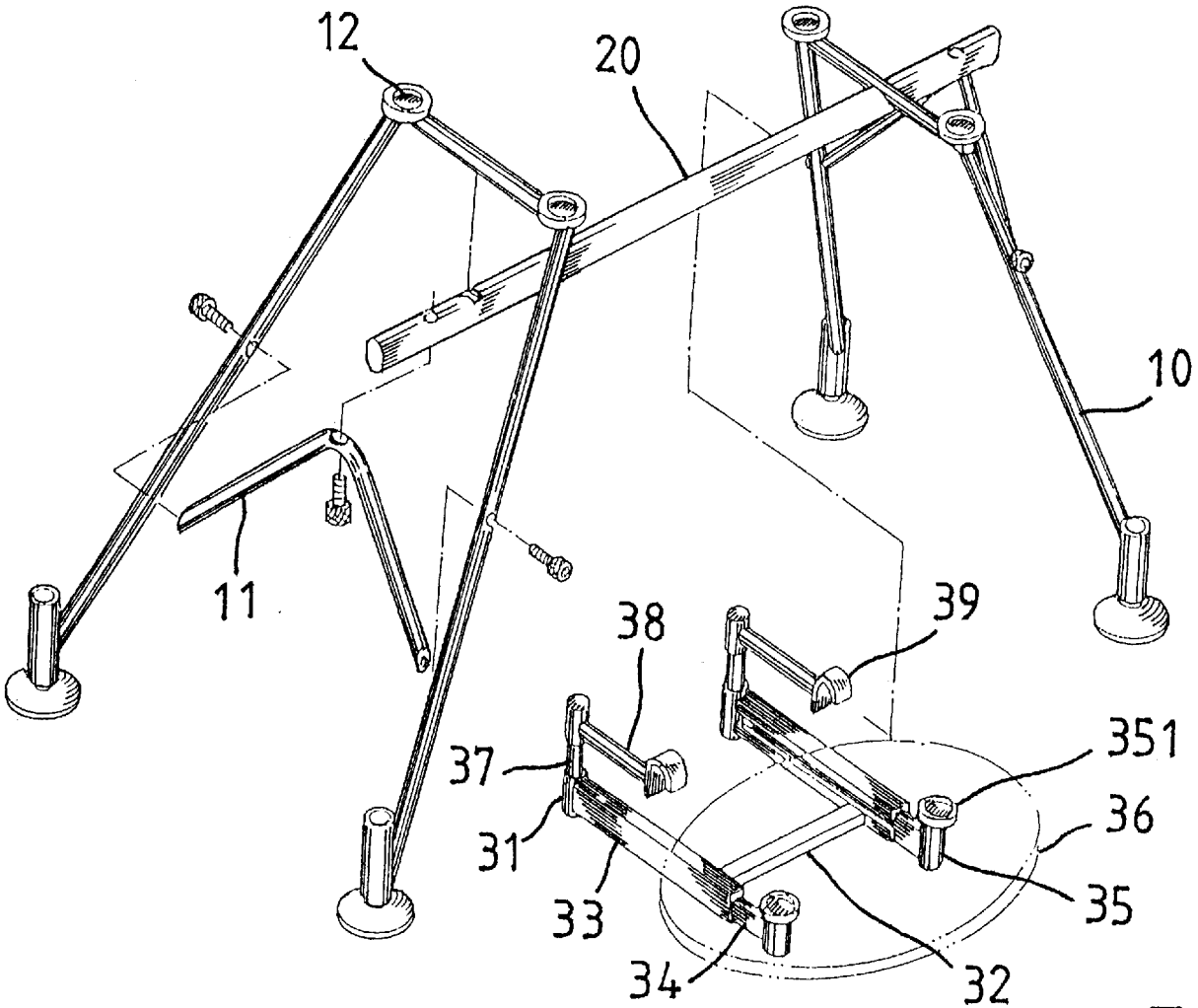
FIG. 1 is an exploded view of the desk frame and the keyboard support device in accordance the present invention.
Figure 2:
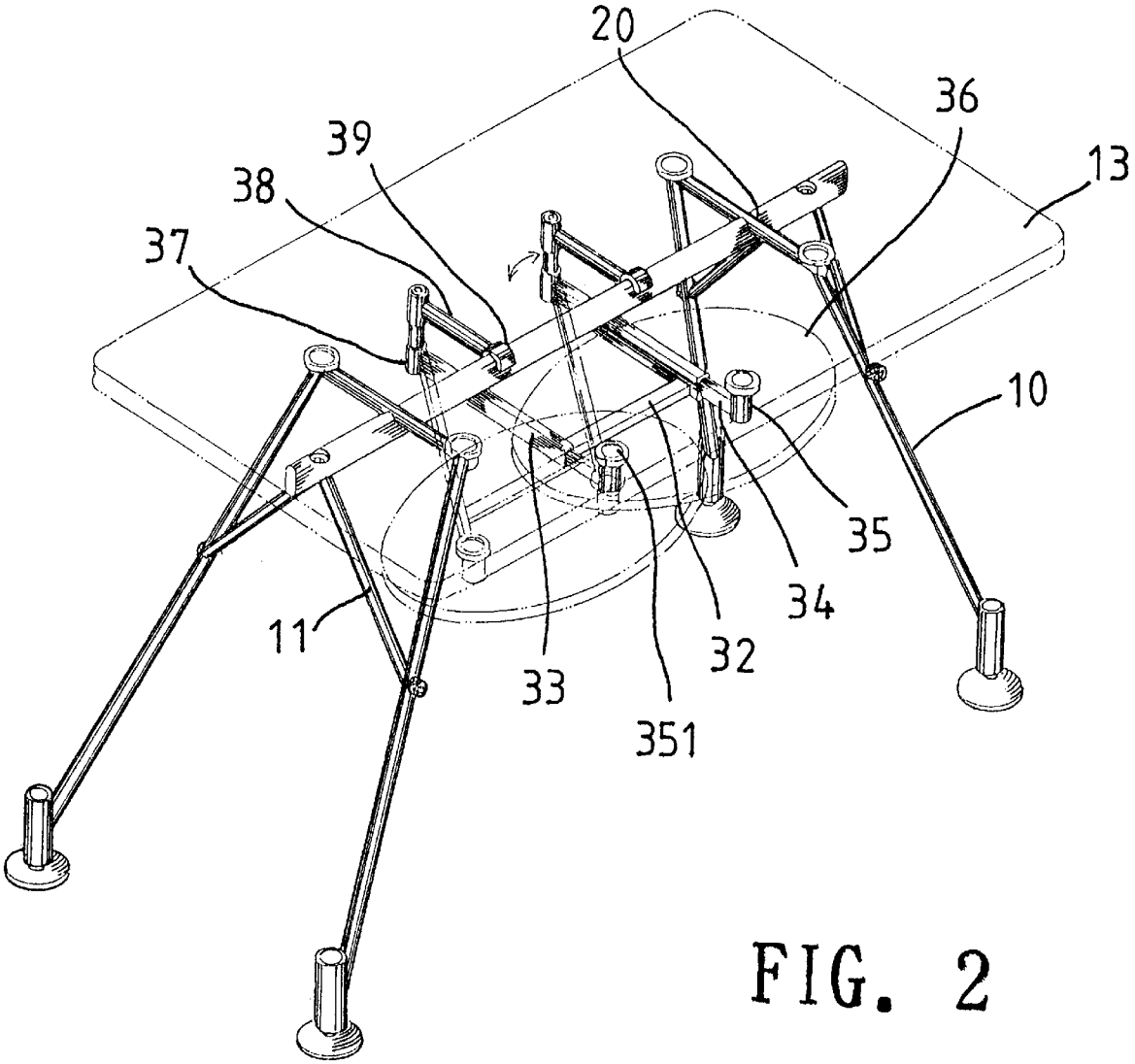
FIG. 2 is a perspective view of the keyboard support device in accordance with the present invention connected beneath the top of the desk.

Referring to FIGS. 1 and 2, a desk has four legs 10 and each leg 10 has a pad 12 so that a top 13 is supported on the pads 12 and connected to the top of the four legs 10. Two legs 10 on the same side have a connecting member 11 connected therebetween. A beam 20 is connected between the two connecting members 11 and located beneath the top 13. The keyboard support device of the present invention comprises two posts 37 each have a rod 38 extending radially outward from the first end thereof and each rod 38 has a hook member 39 connected thereto which is movably engaged with the beam 20 of the desk.

Two rails 33 each have a socket 31 connected to a first end thereof and the two sockets 31 respectively pivotally connected to a second end of the two posts 37 so that the two rails 33 are pivoted relative to the posts 37. A bar 32 is connected between the two rails 33 so as to maintain the two rails 33 in parallel with each other. Each rail 33 has a member 34 slidably received in a second end thereof and a tubular member 35 is connected to each member 34. Two sucking disks 351 are connected to the two tubular members 35 so that a tray 36 is supported on the two sucking disks 351.

Figure 3:
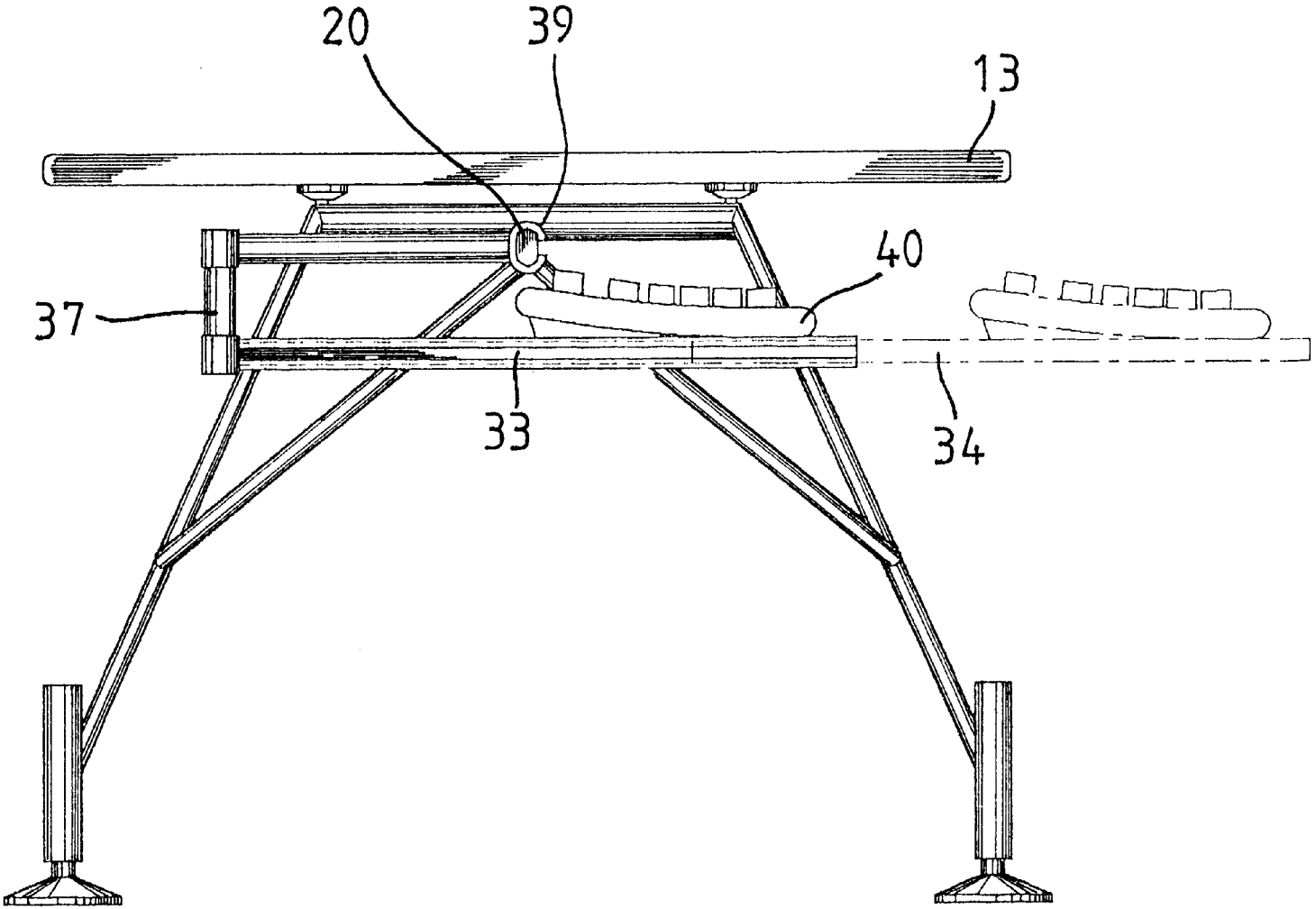
FIG. 3 is a side elevational view to show the keyboard support device is moved relative to the top of the desk.

Referring to FIG. 3, the device can be moved along the beam 20 and the two rails 33 are pivotable relative to the two posts 37 so that the user may move the keyboard tray 36 along the beam 20 and pull the members 34 and/or pivot the two rails 33 to let the keyboard 40 on the keyboard tray 36 positioned at a desired position.

Even if the user unintentionally hits the keyboard tray 36, because the two rails 33 are able to pivot relative to the posts 37 so that the keyboard tray 36 will moved and not hurt the user. According to the device of the present invention, the keyboard can moved any position that a user wants.

The invention is not limited to the above embodiment but various modification thereof may be made. It will be understood by those skilled in the art that various changes in form and detail may made without departing from the scope and spirit of the present invention.

What is claimed is:

1. A keyboard support device comprising:

two posts each having a catching means connected to a first end thereof and said catching means adapted to be connected to a desk;

two rails each having a socket connected to a first end thereof and said two sockets respectively pivotally connected to a second end of said two posts, each rail having a member slidably received in a second end thereof, a bar connected between said two rails, and a tray connected to said two members.

2. The device as claimed in claim 1, wherein each member has a sucking disk connected thereto so that said tray is supported on said two sucking disks.

3. The device as claimed in claim 1, wherein each post comprises a rod extending from said first end thereof and said catching means comprises a hook member connected thereto which is adapted to be engaged with said desk.

4. A keyboard support device comprising:

two posts each having a catching means connected to a first end thereof, each post comprising a rod extending from said first end thereof and said catching means comprising a hook member connected thereto which is adapted to be engaged with said desk;

two rails each having a socket connected to a first end thereof and said two sockets respectively pivotally connected to a second end of said two posts, each rail having a member slidably received in a second end thereof, and a tray connected to said two members.

5. The device as claimed in claim 5 further comprising a bar connected between said two rails.

6. The device as claimed in claim 5, wherein each member has a sucking disk connected thereto so that said tray is supported on said two sucking disks.

* * * * *